United States Patent [19]

Becavin et al.

[11] 4,327,334

[45] Apr. 27, 1982

[54] MULTI-CHANNEL ROTARY JOINT FOR ELECTROMAGNETIC DETECTION EQUIPMENT

[75] Inventors: Henri Becavin; Alain Bailly; Philippe Lemerle, all of Paris, France

[73] Assignee: Thomson-CSF, Paris, France

[21] Appl. No.: 147,289

[22] Filed: May 6, 1980

[30] Foreign Application Priority Data

May 11, 1979 [FR] France ..... 79 11992
May 10, 1979 [JP] Japan ..... 54/57480

[51] Int. Cl.[3] ..... H01P 1/06

[52] U.S. Cl. ..... 333/1; 333/24 C; 333/256

[58] Field of Search ..... 333/256, 261, 24 C, 333/1, 257, 136, 137

[56] References Cited

U.S. PATENT DOCUMENTS 3,123,782 3/1964 Parisi ..... 333/257
4,233,580 11/1980 Treczka et al. ..... 333/261

*Primary Examiner*—Paul L. Gensler
*Attorney, Agent, or Firm*—Karl F. Ross

[57] ABSTRACT

A multi-channel rotary joint, designed to couple a stationary and a rotary component of a radar system to each other, comprises a main channel centered on the axis of rotation and a plurality of axially spaced ancillary channels coaxially surrounding the main channel. Each ancillary channel is formed by two capacitively coupled coplanar rings respectively carried on a stationary and on a rotatable dielectric sleeve centered on the axis, each ring comprising two concentric annular conductor strips on the inner and the outer sleeve surface. The inner and outer conductor strips of each ring are interrupted by small equispaced gaps which are relatively offset to form overlapping segments of two concentric transmission lines which are electrically continuous except at one point at which the line is coupled to a respective balun also formed by arcuate conductor strips.

5 Claims, 5 Drawing Figures

MULTI-CHANNEL ROTARY JOINT FOR ELECTROMAGNETIC DETECTION EQUIPMENT

FIELD OF THE INVENTION

The present invention relates to a multi-channel rotary joint for electromagnetic detection equipment, known generally under the name of radar, including so-called secondary radars with an antenna which rotates in azimuth and in some instances also in elevation. To facilitate the rotation of the antenna independently of associated equipment, a rotary joint is provided which is placed in the supply path of the antenna.

Thus, our invention more particularly relates to a rotary joint, i.e. to a device for transmitting high-frequency energy between two circuits, generally without mechanical contact and with relative rotatability.

BACKGROUND OF THE INVENTION

Rotary joints are well known and an extensive description thereof may be found in Chapter 7 of Volume 9 of the MIT (Massachusetts Institute of Technology) collection "Microwave transmission circuits". However, these rotary joints are not very well adapted to modern radar equipment where, for proper operating conditions, it is necessary to have, between the antenna, on the one hand, and the receiver and transmitter, a relatively high number of separate channels, 4 to 5 in number at least. This is particularly the case in a primary radar associated with a secondary radar whose antenna is mounted on the antenna of the primary radar and where the primary or principal radar must be provided with a transmission channel, a sum reception channel and at least one difference reception channel, whereas the secondary radar must have an interrogation channel, possibly a control channel for suppressing secondary lobes, a sum response channel, a channel for suppressing secondary lobes and a difference channel for establishing the null position.

With a prior-art rotary joint of the "Door Knob" type, for example, it is not possible to have more than three coaxial channels. This limitation comes from the external diameter of the joint which must be less than a wavelength. For a wavelength of the order of 30 cm, a diameter less than $\lambda/\pi$ is of the order of 10 cm.

With a rotary joint of another prior-art type, in which ancillary channels are in the form of rings spread out around the main channel, the number of channels is again limited for reasons of weight and mechanical complexity.

FIG. 1 shows very schematically a conventional rotary joint for a radar comprising, besides a main axial channel 1 with axis of rotation 2, another channel 3 which may be annular. This channel is formed by two identical rings 4, 5, ring 4 being fixed and forming an input while ring 5 is mobile and forms an output. Each ring comprises a so-called coupling disk 6, 7 connected to the input or output terminal by means of a respective distributor 8, 9. At 10 is shown a trap required for this type of joint. The whole assembly is mounted in a casing 11.

FIG. 2 shows schematically in horizontal section one of the rings of FIG. 1, specifically ring 5. As can be seen, the ring is engaged by the associated distributor 9 at four equiphase points a, b, c, d. It is attempted thereby to obtain a substantially uniform flow of the currents without appreciable fluctuation. However, for mechanical reasons, the length of the rings is not small compared with the wavelength. The phase of the HF signal therefore is not constant at all points of the ring. The rotation of one of the rings in relation to the other causes amplitude variations so that neither the amplitude nor the phase of the transmitted signals remains constant. It is necessary to provide traps which are difficult to realize and cause leaks and create spurious couplings between channels. This, added to the fact that the annular channels present a certain mechanical complexity and that the height of the main channel is limited, prevents a joint of this type from being able to accommodate a large number of channels.

OBJECT OF THE INVENTION

The object of our present invention, therefore, is to provide a multi-channel rotary joint of the annular type which is free from the above-mentioned drawbacks.

SUMMARY OF THE INVENTION

We realize this object, in accordance with our present invention, by the provision of a plurality of axially spaced ancillary channels coaxially surrounding a main channel which communicates at opposite ends with an input waveguide and an output wavelength. Each ancillary channel is constituted by two coplanar concentric rings that are capacitively coupled to each other, each ring comprising two concentric annular conductors which are divided by angularly equispaced gaps into a multiplicity of closely spaced arc segments whose length advantageously is on the order of one-eighth of a wavelength at the operating frequency of the electromagnetic detection system whose rotary and stationary components are to be coupled together by the joint. The gaps of the two conductors of each ring are relatively offset whereby the arc segments thereof overlap one another to form an electrically continuous transmission line over substantially a full circle.

As will be apparent hereinafter, however, each transmission line may have a single electrical discontinuity flanked by additional curved conductor strips coaxial and coplanar therewith which define entrance and exit points for microwaves to be transmitted via the respective channel.

BRIEF DESCRIPTION OF THE DRAWINGS

The above and other features of the present invention will become apparent from the following description, given solely by way of non-limiting illustration, when taken in conjunction with the accompanying drawing in which.

SPECIFIC DESCRIPTION

As stated above, multi-channel rotary joints having a number of channels greater than 4 or 5 could not be produced with the prior-art techniques. It is in fact not possible to envisage a coaxial multi-channel joint, since the nesting of the channels limits the maximum possible number of channels to three. It is practically the same for multi-channel joints where the ancillary channels are formed by rings stacked perpendicularly to the main channel. In this case, aside from mechanical stresses, there are problems of spurious coupling due to fluctuations in amplitude and phase of the signals transmitted by the rings, these fluctuations being eliminated by the rotary joint described hereinafter.

Figure 1:
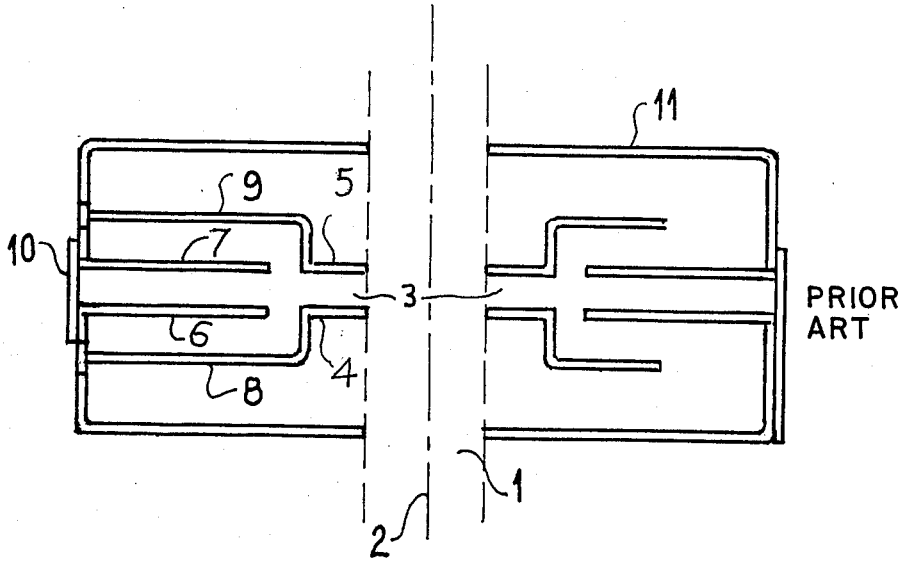
FIGS. 1 and 2, already referred to, represent a rotary joint of the prior art.
Figure 2:
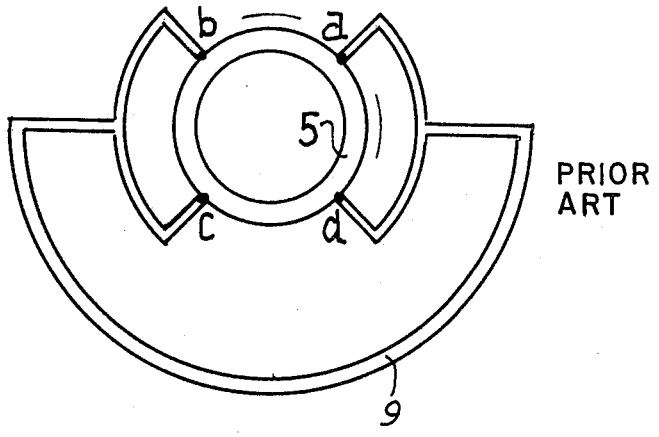
Figure 3:
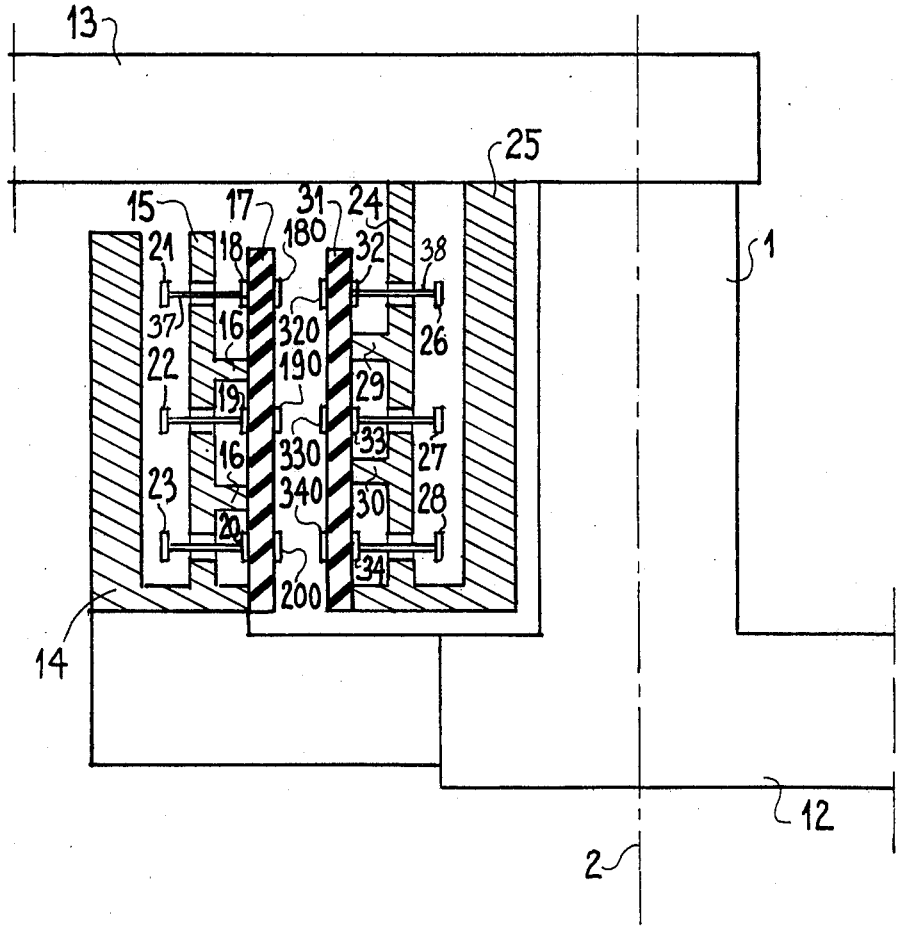
FIG. 3 is a view in vertical section of a joint embodying our invention.

FIG. 3 shows schematically in partial vertical section a multi-channel rotary joint in accordance with the invention. This joint is bounded by an input guide 12, integral with a central channel 1 transmitting signals from the main radar in the particular case where the joint is used with a main-radar/secondary-radar system, and by an output guide 13.

The output guide 13 is rotatable about an axis 2 with respect to the fixed input guide 12. A plurality of axially spaced annular ancillary channels are disposed about the main channel in different horizontal planes. To the stationary guide 12 there is fixed a metallic annular body which is U-shaped in axial cross-section with wall-forming legs 14, 15 parallel to the axis of rotation 2 of the joint; wall 15 carries bosses 16, 16' serving to support a dielectric cylindrical sleeve 17. The latter acts as a support for a group of fixed annular conductors forming part of the ancillary channels, i.e. radially outer conductor strips 18, 19, 20 and radially inner conductor strips 180, 190, 200 in the present instance in which there are three annular channels coaxially surrounding the main channel. The wall 15 further has holes traversed by radially extending stems 37, 38 which support additional conductor strips 21, 22, 23 referred to hereinafter as baluns.

A similar arrangement is provided for the mobile part of the joint which comprises a metallic annular body of U-shaped cross-section having two wall forming legs 24, 25 fixed to the mobile guide 13. Wall 24 has holes traversed by radially extending stems which support baluns 26, 27, 28 and comprises also bosses 29, 30 serving as a support for a dielectric cylindrical sleeve 31 which in turn supports inner and outer mobile annular conductors 32, 33, 34 and 320, 330, 340. It can be seen that the baluns 26–28 are connected to the inner mobile conductors 32–34. Sleeves 17 and 31 are centered on axis 2.

Figure 4:
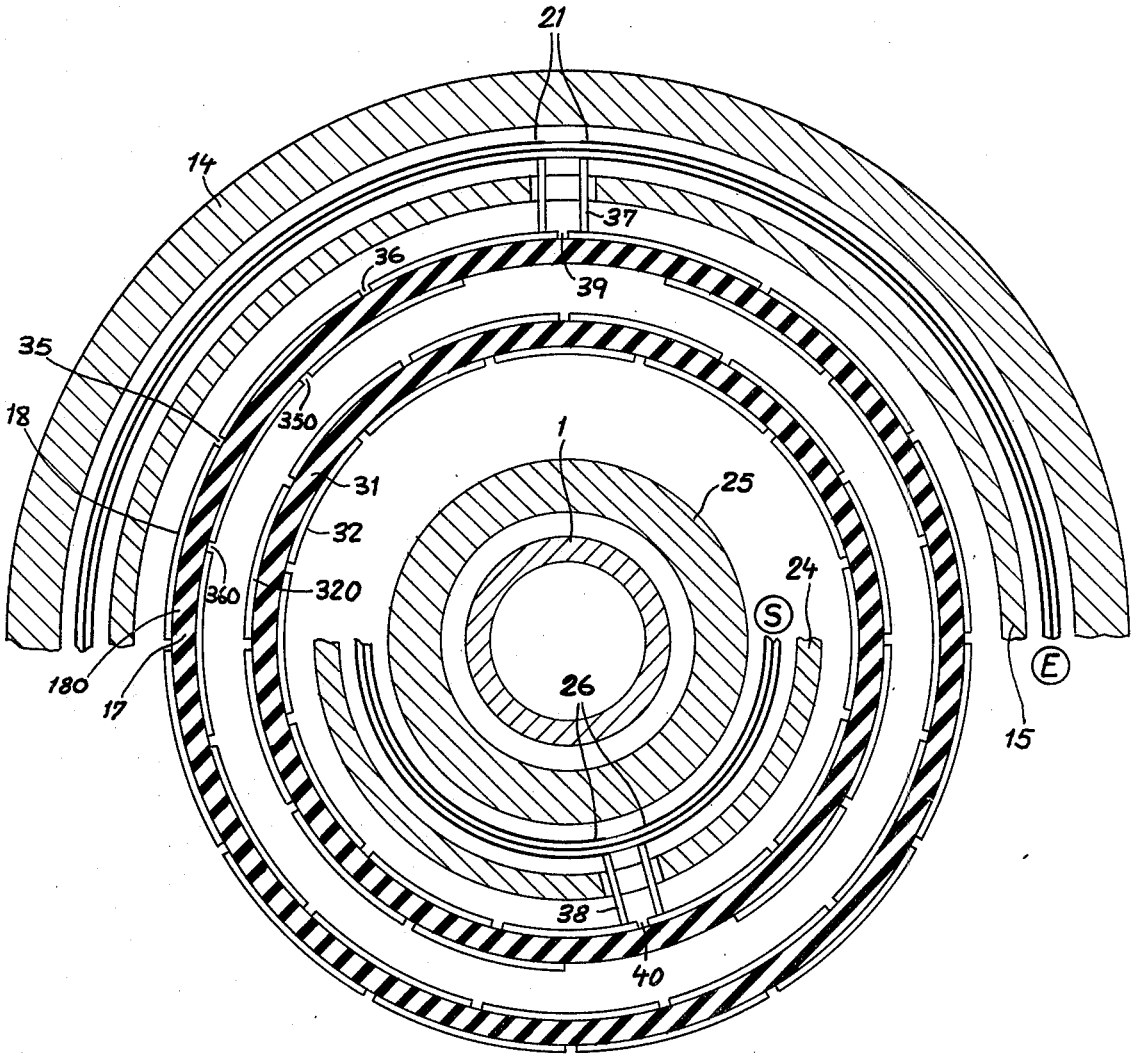
FIG. 4 is a horizontal sectional view of an annular channel of the joint shown in FIG. 3.

FIG. 4 shows in horizontal section an annular channel of the joint of FIG. 3, specifically the one defined by conductors 18, 180, 32 and 320.

Each annular channel comprises two concentric rings and each ring is formed by a concentric pair of inner and outer annular conductors designed as two regularly interrupted transmission lines whose segments are overlappingly, disposed so that there is no electrical discontinuity.

The two transmission lines formed by conductors 18, 180 of the input ring, situated on opposite sides of the dielectric sleeve 17, thus have relatively staggered gaps 35, 36 in line 18 and 350, 360 in lines 180. It will be noted that the gaps of the inner line 180 are substantially opposite the middle of the arc segments of the outer line 18.

The output ring, mobile in relation to the input ring, is similarly formed by two interrupted transmission lines constituted by conductors 32, 320 whose overlapping arc segments are disposed on opposite sides of dielectric sleeve 31. The transmission of the signals between the two rings takes place capacitively.

By an appropriate choice of the coupling coefficient between the two lines, i.e. their mutual capacitance Cm, it can be shown by easy calculation, on the basis of the equations describing the propagation along the system of lines so defined, that all the points of the lines are in phase with one another.

In FIG. 4 we have also shown the relative positions of the inner balun 26, confronting transmission line 32, at the input E and the outer balun 21, confronting transmission line 18, at the output S of the system. The two baluns are required because, with the lines substantially closed on themselves, the phases at respective points of attack must be relatively reversed in order to ensure continuity of the currents in the lines.

It can thus be seen that, because of the coplanar arrangement of the lines in the rings and thus of the mobile and fixed rings of each pair, the phase and the amplitude of the signals to be transmitted are uniform throughout and are independent of the angular position of the two rings. The signals in any annular channel are therefore transmitted practically without loss.

It can be seen from FIG. 3 that several annular channels may be stacked about the main channel of the joint without being limited in number by mechanical restrictions as in the prior art. FIG. 3 shows three annular channels but we could readily have 5 or 6 of them. Their construction is relatively easy. The fixed parts and the mobile parts of the rings are grouped in two bands formed according to printed-circuit technique. In fact, lines 18–180, 19–190 and 20–200 formed as printed circuits are bonded to each side of the dielectric sleeve mounted on the metal bosses 16 of the fixed metal body 14 of the joint. The same goes for lines 32–320, 33–330 and 34–340 mounted on each side of the dielectric strip 31 fixed to the metal bosses 29–30 of the mobile body 12 of the joint. The input and output baluns are also formed as conductive layers on strips supported by the aforementioned stems 37, 38. The thickness of the strips is substantially of the order of 0.1 to 0.2 mm, the air gaps are of the order of 1 to 2 mm, and the total height of a ring is substantially equal to 10 mm.

We prefer to make the physical length of the discontinuous segments of the lines equal to about an eighth of a wavelength, this being a substantially optimum length.

We further provide the channel structure of our improved rotary joint with nonillustrated matching means designed to counterbalance the residual spurious capacitances. In any case, the system presents good stability during rotation, the residual amplitude variation being less than 0.1 dB and the residual phase variation being less than one degree.

From FIG. 4, where the metallic walls 15 and 24 interposed between conductor strips 18, 21 and 26, 32 have been omitted, it will also be noted that the two curved strips of the outer balun 21 as well as the two curved strips of the inner balun 26 flank respective electrical discontinuities in the adjoining rings coplanar therewith. One such discontinuity is formed by a gap 39 between arc segments 18 and the omission of a segment 180 on the opposite side of sleeve 17, another discontinuity being similarly formed by a gap 40 between arc segments 32 and the omission of a segment 320 on the opposite side of sleeve 31. Gaps 39 and 40 are the aforementioned points of attack; channel entrances E and exits S lie in the spaces between the pairs of walls 24, 25 and 14, 15.

Figure 5:
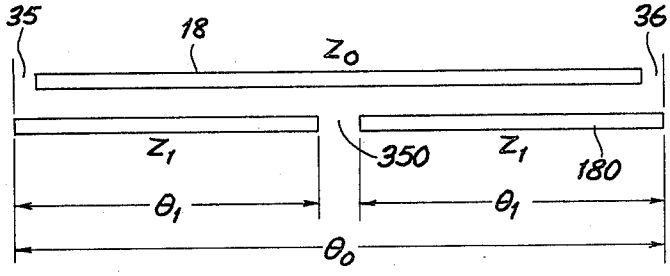
FIG. 5 shows certain parameters of a portion of an annular channel of that joint.

In FIG. 5 we have indicated at $Z_0$, $Z_1$ the impedances of arc segments 18 and 180, at $\theta_1$ their arc length and at $\theta_0$ the arc length of their gaps.

What is claimed is:

1. A multi-channel rotary joint for coupling a stationary and a rotary component of an electromagnetic detection system to each other, comprising:

a main channel centered on an axis of rotation of said rotary component, said main channel communicating at opposite ends with an input waveguide and an output waveguide; and a plurality of axially spaced ancillary channels coaxially surrounding said main channel, each of said ancillary channels being constituted by two coplanar concentric rings capacitively coupled to each other, each of said rings comprising two concentric annular conductors divided by angularly equispaced gaps into a multiplicity of closely spaced arc segments, the gaps of said conductors being relatively offset whereby the arc segments of each ring overlap one another to form an electrically continuous transmission line over substantially a full circle.

2. A rotary joint as defined in claim 1 wherein said components respectively include a stationary and a rotatable dielectric sleeve centered on said axis, the annular conductors of each ring being carried on an inner and an outer surface of one of said sleeves.

3. A rotary joint as defined in claim 2 wherein said components further include respective metallic annular bodies of U-shaped axial cross-section forming a pair of first walls rigid with the outer one of said sleeves and a pair of second walls rigid with the inner one of said sleeves, the wall of each pair proximal to the respective sleeve having apertures traversed by stems extending radially from the sleeve, said stems carrying additional conductors curved about said axis in the space formed by the respective pair of walls, said additional conductors terminating at channel entrances in one of said bodies and at channel exits in the other of said bodies.

4. A rotary joint as defined in claim 3 wherein said additional conductors extend on opposite sides of an electrical discontinuity of a respective ring coplanar therewith.

5. A rotary joint as defined in claim 1, 2, 3 or 4 wherein each of said arc segments has a length on the order of one-eighth of a wavelength at the operating frequency of the system.

* * * * *